US010982154B2

(12) United States Patent
Park

(10) Patent No.: US 10,982,154 B2
(45) Date of Patent: Apr. 20, 2021

(54) MULTISTORY CRUDE OIL REFINING APPARATUS

(71) Applicant: Yongil Park, Gyeonggi-Do (KR)

(72) Inventor: Yongil Park, Gyeonggi-Do (KR)

( * ) Notice: Subject to any disclaimer, the term of this patent is extended or adjusted under 35 U.S.C. 154(b) by 506 days.

(21) Appl. No.: 16/110,636

(22) Filed: Aug. 23, 2018

(65) Prior Publication Data

US 2019/0062640 A1 Feb. 28, 2019

(30) Foreign Application Priority Data

Aug. 30, 2017 (KR) ..... 10-2017-0110542

(51) Int. Cl.
*C10G 7/00* (2006.01)

(52) U.S. Cl.
CPC ..... *C10G 7/00* (2013.01)

(58) Field of Classification Search
CPC ..... C10G 7/00; C10G 31/06; C10G 53/02; C10G 2300/4012; B01D 1/02; B01D 3/02; B01D 3/04; B01D 3/065; B01D 3/06; B01D 3/12; B01D 3/14; B01D 3/143; B01D 3/42
See application file for complete search history.

(56) References Cited

U.S. PATENT DOCUMENTS 2,252,550 A * 8/1941 Bragg ..... C10G 7/00 208/350
3,985,623 A * 10/1976 Morgan ..... B01D 3/18 196/132
5,132,918 A * 7/1992 Funk ..... B01D 3/4272 201/1

* cited by examiner

*Primary Examiner* — Randy Boyer
*Assistant Examiner* — Juan C Valencia
(74) *Attorney, Agent, or Firm* — Heedong Chae; Lucem, PC

(57) ABSTRACT

The multistory crude oil refining apparatus includes: a crude oil receiving part; a first refining tank, wherein a first heater is mounted in the first refining tank; at least one first processed oil discharge pipe connected to one side of the first refining tank; a first processed oil discharge pipe pressure sensitive switch; at least one first impurity discharge pipe connected to the other side of the first refining tank; a first impurity discharge pipe pressure sensitive switch; a second refining tank, wherein a second heater is mounted in the second refining tank; at least one second processed oil discharge pipe connected to one side of the second refining tank; a second processed oil discharge pipe pressure sensitive switch; at least one second impurity discharge pipe connected to the other side of the second refining tank; and a second impurity discharge pipe pressure sensitive switch.

6 Claims, 4 Drawing Sheets

MULTISTORY CRUDE OIL REFINING APPARATUS

CROSS-REFERENCE TO RELATED APPLICATIONS

This application is based on and claims the benefit of priority to Korean Patent Application No. 10-2017-0110542 filed on Aug. 30, 2017, with the Korean Intellectual Property Office, the disclosure of which is incorporated herein by reference.

BACKGROUND OF THE INVENTION

Field of the Invention

The present invention relates to a multistory crude oil refining apparatus, and, more particularly, to a multistory crude oil refining apparatus, which has a vertically arranged multistory structure and is capable of producing activated oil using a pressure sensitive switch in order to individually and continuously produce naphtha, kerosene, diesel, and residue from crude oil through pressure control, reducing an occupied area of facilities, and enhancing productivity per unit time.

Background Art

Refinement means a series of skills to manufacture various petroleum products and half-finished products by distilling crude oil.

The main component of crude oil is hydrocarbon, and hydrocarbon has different qualities according to the number and coupled shapes of carbon atoms and hydrogen atoms and is classified into various kinds, such as methane, propane, benzene, and others.

Hydrocarbon is divided by distillation, namely, divided into LPG, naphtha (30° C. to 130° C.), kerosene (180° C. to 250° C.), diesel (250° C. to 350° C.), and residue (above 400° C.) according to difference in boiling points. Here, naphtha is a source of gasoline and petrochemistry, and residue becomes heavy oil, bunker C oil, lubricating oil, asphalt, paraffin, and so on.

Petroleum does not directly burn in a liquid state, but hydrocarbon contained in gas evaporated from petroleum burns by being mixed with oxygen contained in the air.

When a mixing ratio is within a predetermined explosion range under a predetermined temperature, ignition occurs, and the temperature at the time of ignition is called a flash point. Because the flash point of petroleum is lower than flash points of other materials, petroleum is easy to burn. Specifically, petroleum is ignited even above the surface of water since being lighter than water.

In the meantime, a facility to refine crude oil is called a crude oil refining facility. Korea is oil-poor, but Korea has upgrading facilities with a high value, namely, highly developed crude oil refining facilities, to produce and export high class crude oil by refining and processing crude oil.

However, the existing crude oil refining facilities individually includes crude oil heating apparatuses to individually obtain naphtha, kerosene, diesel, and residue. So, the existing crude oil refining facilities have a disadvantage in that productivity per unit time suffers due to a structural limitation of the facilities. Therefore, the need for multistory crude oil refining apparatuses of a new concept arises.

PATENT LITERATURE

Patent Documents

Patent Document 1: Korean Patent Application No. 10-2002-7005837

Patent Document 2: Korean Patent Application No. 10-2009-0022541

Patent Document 3: Korean Patent Application No. 10-2010-0030421

Patent Document 4: Korean Patent Application No. 10-2015-0055688

SUMMARY OF THE INVENTION

Accordingly, the present invention has been made to solve the above-mentioned problems occurring in the prior arts, and it is an object of the present invention to provide a multistory crude oil refining apparatus, which has a vertically arranged multistory structure and is capable of producing activated oil using a pressure controller in order to individually and continuously produce naphtha, kerosene, diesel, and residue from crude oil through pressure control, reducing an occupied area of facilities, and enhancing productivity per unit time.

To accomplish the above object, according to the present invention, there is provided a multistory crude oil refining apparatus including: a crude oil receiving part, which receives crude oil to be refined and has an inlet; a first refining tank, which is a lower layer of the crude oil receiving part and forms a place to refine the crude oil provided from the crude oil receiving part into a first processed oil, wherein a first heater is mounted in the first refining tank; at least one first processed oil discharge pipe connected to one side of the first refining tank, wherein the first processed oil refined in the first refining tank is discharged out through the first processed oil discharge pipe; a first processed oil discharge pipe pressure sensitive switch disposed on the first processed oil discharge pipe to be openable; at least one first impurity discharge pipe connected to the other side of the first refining tank, wherein impurities on the first refining tank are discharged out through the first impurity discharge pipe; a first impurity discharge pipe pressure sensitive switch disposed on the first impurity discharge pipe to be openable; a second refining tank, which is a lower layer of the first refining tank, and forms a place to refine processed oil provided from the first refining tank into a second processed oil, wherein a second heater is mounted in the second refining tank; at least one second processed oil discharge pipe connected to one side of the second refining tank, wherein the second processed oil refined in the second refining tank is discharged out through the second processed oil discharge pipe; a second processed oil discharge pipe pressure sensitive switch disposed on the second processed oil discharge pipe to be openable; at least one second impurity discharge pipe connected to the other side of the second refining tank, wherein impurities on the second refining tank are discharged out through the second impurity discharge pipe; and a second impurity discharge pipe pressure sensitive switch disposed on the second impurity discharge pipe to be openable.

The multistory crude oil refining apparatus further includes: a third refining tank, which is a lower layer of the second refining tank, and forms a place to refine processed oil provided from the second refining tank into a third processed oil, wherein a third heater is mounted in the third refining tank; at least one third processed oil discharge pipe connected to one side of the third refining tank, wherein the third processed oil refined in the third refining tank is discharged out through the third processed oil discharge pipe; a third processed oil discharge pipe pressure sensitive switch disposed on the third processed oil discharge pipe to be openable; at least one third impurity discharge pipe connected to the other side of the third refining tank, wherein impurities on the third refining tank are discharged out through the third impurity discharge pipe; and a third impurity discharge pipe pressure sensitive switch disposed on the third impurity discharge pipe to be openable.

The multistory crude oil refining apparatus further includes: a fourth refining tank, which is a lower layer of the third refining tank, and forms a place to refine processed oil provided from the third refining tank into a fourth processed oil, wherein a fourth heater is mounted in the fourth refining tank; at least one fourth processed oil discharge pipe connected to one side of the fourth refining tank, wherein the fourth processed oil refined in the fourth refining tank is discharged out through the fourth processed oil discharge pipe; a fourth processed oil discharge pipe pressure sensitive switch disposed on the fourth processed oil discharge pipe to be openable; at least one fourth impurity discharge pipe connected to the other side of the fourth refining tank, wherein impurities on the fourth refining tank are discharged out through the fourth impurity discharge pipe; and a fourth impurity discharge pipe pressure sensitive switch disposed on the fourth impurity discharge pipe to be openable.

The first processed oil, the second processed oil, the third processed oil, and the fourth processed oil are respectively naphtha, kerosene, diesel, and residue, which have different boiling points, and the first refining tank, the second refining tank, the third refining tank, and the fourth refining tank form a vertically arranged multistory structure. A first gate valve is disposed between the first refining tank and the second refining tank, a second gate valve is disposed between the second refining tank and the third refining tank, and a third gate valve is disposed between the third refining tank and the fourth refining tank.

The multistory crude oil refining apparatus further includes: a controller for controlling operations of the first to fourth processed oil discharge pipe pressure sensitive switches and the first to fourth impurity discharge pipe pressure sensitive switches and operations of the first to third gate valves by the action of the first to fourth heaters.

The first refining tank, the second refining tank, the third refining tank, and the fourth refining tank have different sizes from one another, and have volumes increasing downwards.

According to the present invention, the multistory crude oil refining apparatus has a vertically arranged multistory structure, and is capable of producing activated oil using a pressure controller in order to individually and continuously produce naphtha, kerosene, diesel, and residue from crude oil through pressure control, reducing an occupied area of facilities, and enhancing productivity per unit time.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Figure 1:
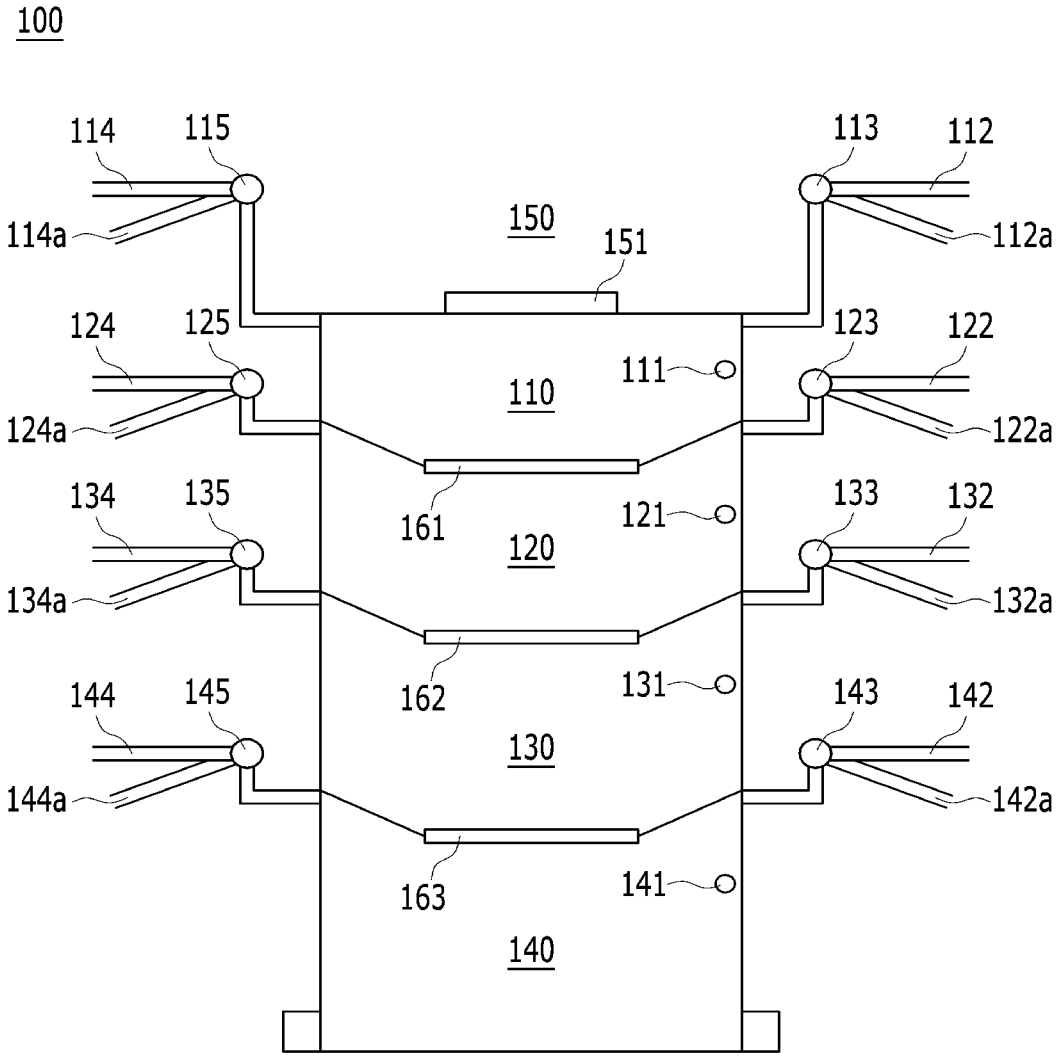
FIG. 1 is a schematic side view showing a structure of a multistory crude oil refining apparatus according to a preferred embodiment of the present invention.

Reference will be now made in detail to the preferred embodiments of the present invention with reference to the attached drawings so as to be easily embodied by those of ordinary skill in the art.

However, it should be understood that the technical scope of the present invention is not limited by the specific embodiments since the exemplary embodiments are nothing more than embodiments for structural and functional descriptions.

For instance, the specific embodiments may have various changes and forms, so it should be understood that the present invention includes all changes, equivalents, or modifications included in the spirit and scope of the present invention.

Moreover, it should be understood that the scope of the present invention is not limited by the proposed objects or effects since the proposed objects or effects do not mean that the specific embodiments must include all of the objects or effects or must include only the proposed objects or effects.

In this specification, the exemplary embodiments of the present invention are provided to perfectly disclose the present invention and to let those skilled in the art perfectly know the scope of the present invention. Additionally, the present invention is defined by the scope of the appended claims.

In a case where it is determined that detailed description of well-known features and configurations according to the present disclosure and all other matters unnecessarily obscure the gist of the present disclosure, the detailed description will be omitted.

In the meantime, meanings of terms used in the present invention are not limited to the dictionary definitions and may be understood as follows.

It should be also understood that the expression that some component is 'connected' to another component means that some component may be directly connected to another component or may be connected to another component through a further component. On the contrary, it should be understood that the expression that some component is 'directly connected' to another component means that there is no a further component between the above-mentioned components. Meanwhile, it should be also understood that other expressions to describe relations among components, for instance, 'between ~', 'directly between ~', or 'adjoining to' and 'directly adjoining to', should be interpreted in the same way.

The expression for singular shall include the plural meaning unless otherwise interpreted clearly in the context. The terminologies of "include" or "have" in this specification is to define the existence of the characteristics, figures, stage, motion, constituent element, part or its combination, and it shall be understood not as excluding the existence and the additional possibilities of one or more other characteristics, figure, stage, motion, constituent element, part or its combination.

Every terminology used herein including the technical and scientific terminologies has the same meaning with the general understanding by the person with general knowledge in the technical part where present invention is categorized unless otherwise defined. The terminologies defined in the dictionary which are used generally shall be interpreted as to have the same meaning with context of the related technology and it shall not be interpreted as ideal or excessively formative meaning unless otherwise clearly defined herein.

Hereinafter, exemplary embodiments of the present invention will be described with reference to the accompanying drawings. In the following description, the same components will be designated by the same reference numerals, and according to circumstances, descriptions of the same reference numerals will be omitted.

Embodiment 1

Figure 2:
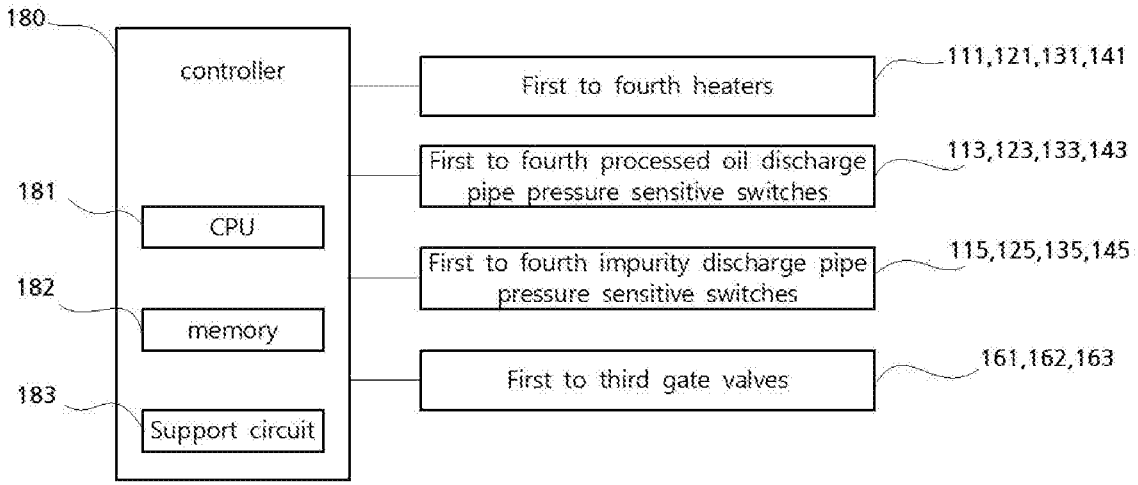
FIG. 2 is a control block diagram of the multistory crude oil refining apparatus of FIG. 1.

FIG. 1 is a schematic side view showing a structure of a multistory crude oil refining apparatus according to a preferred embodiment of the present invention, and FIG. 2 is a control block diagram of the multistory crude oil refining apparatus of FIG. 1.

Referring to the drawings, the multistory crude oil refining apparatus 100 according to the preferred embodiment of the present invention has a vertically arranged multistory structure, and is capable of individually and continuously producing naphtha, kerosene, diesel, and residue from crude oil through pressure control, producing products of various forms using activation of oil through the property that oils have different boiling points, reducing an occupied area of facilities, and enhancing productivity per unit time.

The multistory crude oil refining apparatus 100 according to the preferred embodiment of the present invention includes a crude oil receiving part 150 having a vertically arranged multistory structure formed along a lower portion, a first refining tank 110, a second refining tank 120, a third refining tank 130, and a fourth refining tank 140. Some skills in this embodiment may cite Korean Patent No. 10-1664350 which has been invented by the inventor of the present invention.

In this embodiment, since crude oil is divided into four kinds of processed oil, namely, naphtha, kerosene, diesel, and residue, the multistory crude oil refining apparatus 100 according to the preferred embodiment of the present invention has a four-story arrangement structure.

However, the scope of the present invention is not limited by the above structure. That is, the multistory crude oil refining apparatus 100 according to the preferred embodiment of the present invention may have a two-story structure, a three-story structure, or a vertically arranged structure with five or more stories, and all matters related with the above should belong to the technical scope of the present invention.

Hereinafter, for convenience in description, it will be described that crude oil is divided into naphtha (30° C. to 130° C.), kerosene (180° C. to 250° C.), diesel (250° C. to 350° C.), and residue (above 400° C.) according to the existing crude oil refining method, namely, according to difference in boiling points. For your reference, naphtha is a source of gasoline and petrochemistry, and residue may become heavy oil, bunker C oil, lubricating oil, asphalt, paraffin, and so on.

In the meantime, the present invention can individually and continuously produce naphtha, kerosene, diesel, and residue from crude oil through pressure control. In this instance, as described above, naphtha may be a source of gasoline and petrochemistry, due to the difference in boiling points. That is, the present invention can produce products of various forms through activation of oil since being capable of obtaining products, namely, oil, with different properties according to boiling points in a particular section of 30° C. to 130° C.

Now, a detailed structure of the multistory crude oil refining apparatus 100 according to the preferred embodiment of the present invention will be described. First, the crude oil receiving part 150 is a place where crude oil to be refined is received. The crude oil receiving part 150 has an inlet 151 through which crude oil is put in.

The first refining tank 110 is a lower layer of the crude oil receiving part 150, and forms a place to refine crude oil provided from the crude oil receiving part 150 into a first processed oil, namely, naphtha. The first refining tank 110 has a first heater 111 mounted therein. Not shown in the drawings, but a cooling device may be attached around the first heater 111 in order to manage temperature.

One or more first processed oil discharge pipes 112 for discharging the first processed oil refined in the first refining tank 110 is connected at one side of the first refining tank 110. In this embodiment, a plurality of the first processed oil discharge pipes 112 are disposed to the first refining tank 110, but the scope of the present invention is not limited by the above. Not shown in the drawings, a storage facility for collecting the first processed oil is connected to the first processed oil discharge pipes 112.

A first processed oil discharge pipe pressure sensitive switch 113 is disposed on the first processed oil discharge pipe 112 to be openable. The pressure sensitive switch 113 is controlled by a controller 180.

The first refining tank 110 further includes one or more first impurity discharge pipes 114 disposed at the other side thereof to discharge impurities on the first refining tank 110. In this embodiment, a plurality of the first impurity discharge pipes 114 are disposed to the first refining tank 110, but the scope of the present invention is not limited by the above.

A first impurity discharge pipe pressure sensitive switch 115 is disposed on the first impurity discharge pipe 114 to be openable. The first impurity pressure sensitive switch 115 is also controlled by the controller 180.

The second refining tank 120 is a lower layer of the first refining tank 110, and forms a place to refine the processed oil provided from the first refining tank 110 into a second processed oil, namely, kerosene. The second refining tank 120 has a second heater 121 mounted therein. Not shown in the drawings, but a cooling device may be attached around the second heater 121 in order to manage temperature.

One or more second processed oil discharge pipes 122 for discharging the second processed oil refined in the second refining tank 120 is connected at one side of the second refining tank 120. In this embodiment, a plurality of the second processed oil discharge pipes 122 are disposed to the second refining tank 120, but the scope of the present invention is not limited by the above.

A second processed oil discharge pipe pressure sensitive switch 123 is disposed on the second processed oil discharge pipe 122 to be openable. The second processed oil discharge pipe pressure sensitive switch 123 is controlled by the controller 180.

The second refining tank 120 further includes one or more second impurity discharge pipes 124 disposed at the other side thereof to discharge impurities on the second refining tank 120. In this embodiment, a plurality of the second impurity discharge pipes 124 are disposed to the second refining tank 120, but the scope of the present invention is not limited by the above.

A second impurity discharge pipe pressure sensitive switch 125 is disposed on the second impurity discharge pipe 124 to be openable. The second impurity pressure sensitive switch 125 is also controlled by the controller 180.

The third refining tank 130 is a lower layer of the second refining tank 120, and forms a place to refine the processed oil provided from the second refining tank 120 into a third processed oil, namely, diesel. The third refining tank 130 has a third heater 131 mounted therein. Not shown in the drawings, but a cooling device may be attached around the third heater 131 in order to manage temperature.

One or more third processed oil discharge pipes 132 for discharging the third processed oil refined in the third refining tank 130 is connected at one side of the third refining tank 130. In this embodiment, a plurality of the third processed oil discharge pipes 132 are disposed to the third refining tank 130, but the scope of the present invention is not limited by the above.

A third processed oil discharge pipe pressure sensitive switch 133 is disposed on the third processed oil discharge pipe 132 to be openable. The third processed oil discharge pipe pressure sensitive switch 133 is controlled by the controller 180.

The third refining tank 130 further includes one or more third impurity discharge pipes 134 disposed at the other side thereof to discharge impurities on the third refining tank 130. In this embodiment, a plurality of the third impurity discharge pipes 134 are disposed to the third refining tank 130.

A third impurity discharge pipe pressure sensitive switch 135 is disposed on the third impurity discharge pipe 134 to be openable. The third impurity pressure sensitive switch 135 is also controlled by the controller 180.

The fourth refining tank 140 is a lower layer of the third refining tank 130, and forms a place to refine the processed oil provided from the third refining tank 130 into a fourth processed oil, namely, residue. The fourth refining tank 140 has a fourth heater 141 mounted therein. Not shown in the drawings, but a cooling device may be attached around the fourth heater 141 in order to manage temperature.

One or more fourth processed oil discharge pipes 142 for discharging the fourth processed oil refined in the fourth refining tank 140 is connected at one side of the fourth refining tank 140. In this embodiment, a plurality of the fourth processed oil discharge pipes 142 are disposed to the fourth refining tank 140, but the scope of the present invention is not limited by the above.

A fourth processed oil discharge pipe pressure sensitive switch 143, which is controlled by the controller 180, is disposed on the fourth processed oil discharge pipe 142 to be openable.

The fourth refining tank 140 further includes one or more fourth impurity discharge pipes 144 disposed at the other side thereof to discharge impurities on the fourth refining tank 140. A plurality of the fourth impurity discharge pipes 144 are disposed to the fourth refining tank 140.

A fourth impurity discharge pipe pressure sensitive switch 145 is disposed on the fourth impurity discharge pipe 144 to be openable. The fourth impurity pressure sensitive switch 145 is also controlled by the controller 180.

In the meantime, as described above, the first refining tank 110, the second refining tank 120, the third refining tank 130, and the fourth refining tank 140 are mounted to form a vertically arranged multistory structure.

In this instance, the first to fourth refining tanks 110, 120, 130 and 140 have different shapes or areas in order to produce and collect processed oils at the same speed in the first to fourth refining tanks 110, 120, 130 and 140 according to discharge speed of the processed oils of the first to fourth refining tanks 110, 120, 130 and 140.

For instance, in this embodiment, the first to fourth refining tanks 110, 120, 130 and 140 may have different sizes and have volumes increasing downwards. According to the above structure, if crude oil is continuously put in, the first to fourth refining tanks 110, 120, 130 and 140 may complete production and collection of the processed oils in almost the same way, and sequentially repeat the process of moving on to the next step at around the same time. Therefore, the present invention enhances productivity.

A first gate valve 161 is disposed between the first refining tank 110 and the second refining tank 120, a second gate valve 162 is disposed between the second refining tank 120 and the third refining tank 130, and a third gate valve 163 is disposed between the third refining tank 130 and the fourth refining tank 140.

The first to third gate valves 161, 162 and 163 are controlled by the controller 180 to make the processed oils of upper layers drop down to lower layers.

In the meantime, the controller 180 controls operations of the first to fourth processed oil discharge pipe pressure sensitive switches 113, 123, 133 and 143 and the first to fourth impurity discharge pipe pressure sensitive switches 115, 125, 135 and 145 and operations of the first to third gate valves 161 to 163 by the action of the first to fourth heaters 111, 121, 131 and 141.

That is, when the processed oils to be collected into the first to fourth refining tanks 110, 120, 130 and 140 are heated to proper temperature, the processed oils to be collected are collected through the corresponding first to fourth processed oil discharge pipes 112, 122, 132 and 142. If pressure drops, the controller 180 opens the first to fourth impurity discharge pipe pressure sensitive switches 115, 125, 135 and 145 to heat the oils at higher temperature, and then, discharges impurities through the first to fourth impurity discharge pipes 114, 124, 134 and 144. The controller 180 opens the first to third gate valves 161 to 163 at about 5° C. lower temperature than the temperature proper to the second to fourth refining tanks 120, 130 and 140, which are the lower layers, so that the oils are induced into the second to fourth refining tanks 120, 130 and 140, which are the lower layers, and the above-mentioned processes are repeated.

For instance, when the first refining tank 110 is heated to 130° C. by the action of the first heater 111, naphtha, which is the first processed oil, is produced in the first refining tank 110. The first processed oil is discharged out through the first processed oil discharge pipes 112 by an opening action of the first processed oil discharge pipe pressure sensitive switch 113. When the internal pressure of the first refining tank 110 drops down after the first processed oil is discharged out, the first processed oil discharge pipe pressure sensitive switch 113 is closed but the first impurity discharge pipe pressure sensitive switch 115 is automatically opened by the controller 180. In this instance, the first heater 111 heats at temperature, which is higher than 130° C. but lower than 180° C. that kerosene as the second processed oil is produced, so that impurities in the first refining tank 110 are discharged out through the first impurity discharge pipe 114. In the above process, when pressure drops again, the first gate valve 161 is naturally opened, and the crude oil in the first refining tank 110 is put into the second refining tank 120, so that kerosene as the second processed oil is produced and discharged through the second refining tank 120. The controller 180 organically controls operations of the above components to sequentially repeat the above processes.

The controller 180 may include a central processing unit (CPU) 181, a memory 182, and a support circuit 183.

The CPU 181 may be one among various computer processors industrially applicable in order to control operations of the first to fourth processed oil discharge pipe pressure sensitive switches 113, 123, 133 and 143 and the first to fourth impurity discharge pipe pressure sensitive switches 115, 125, 135 and 145 and operations of the first to third gate valves 161 to 163 by the action of the first to fourth heaters 111, 121, 131 and 141.

The memory 182 is connected with the CPU 181. The memory 182 is a computer readable recording medium, and may be mounted at a local place or at a remote place, for instance, may be at least one among a random access memory (RAM), a ROM, a floppy disc, a hard disc, and a specific digital storage device, which are easily accessible.

The support circuit 183 is combined with the CPU 181 to support a typical action of the processor. Such a support circuit 183 may include a cache, a power supply, a clock circuit, an input/output circuit, a sub system, and so on.

In this embodiment, the controller 180 controls operations of the first to fourth processed oil discharge pipe pressure sensitive switches 113, 123, 133 and 143 and the first to fourth impurity discharge pipe pressure sensitive switches 115, 125, 135 and 145 and operations of the first to third gate valves 161 to 163 by the action of the first to fourth heaters 111, 121, 131 and 141. In this instance, when the processed oils to be collected into the first to fourth refining tanks 110, 120, 130 and 140 are heated to proper temperature, the processed oils to be collected are collected through the corresponding first to fourth processed oil discharge pipes 112, 122, 132 and 142. If pressure drops, the controller 180 opens the first to fourth impurity discharge pipe pressure sensitive switches 115, 125, 135 and 145 to heat the oils at higher temperature, and then, discharges impurities through the first to fourth impurity discharge pipes 114, 124, 134 and 144. The controller 180 opens the first to third gate valves 161 to 163 at about 5° C. lower temperature than the temperature proper to the second to fourth refining tanks 120, 130 and 140, which are the lower layers, so that the oils are induced into the second to fourth refining tanks 120, 130 and 140, which are the lower layers, and the above-mentioned processes are repeated. A series of the above-mentioned processes to control the above processes are stored in the memory 182. Typically, a software routine may be stored in the memory 182. The software routine may be stored or executed by another CPU (not shown).

In this embodiment, it is described that the processes according to the present invention are executed by the software routine, but at least some of the processes may be executed by hardware. As described above, the processes of the present invention may be realized by software executed on a computer system or by hardware, such as an integrated circuit, or by combination of software and hardware.

According to the embodiment having the above-mentioned structure and action, the multistory crude oil refining apparatus has the vertically arranged multistory structure, and is capable of individually and continuously producing naphtha, kerosene, diesel, and residue from crude oil through pressure control, reducing an occupied area of facilities, and enhancing productivity per unit time.

Furthermore, the multistory crude oil refining apparatus according to the present invention can produce products of various forms using activation of oil through the property that oils have different boiling points.

Embodiment 2

Figure 3:
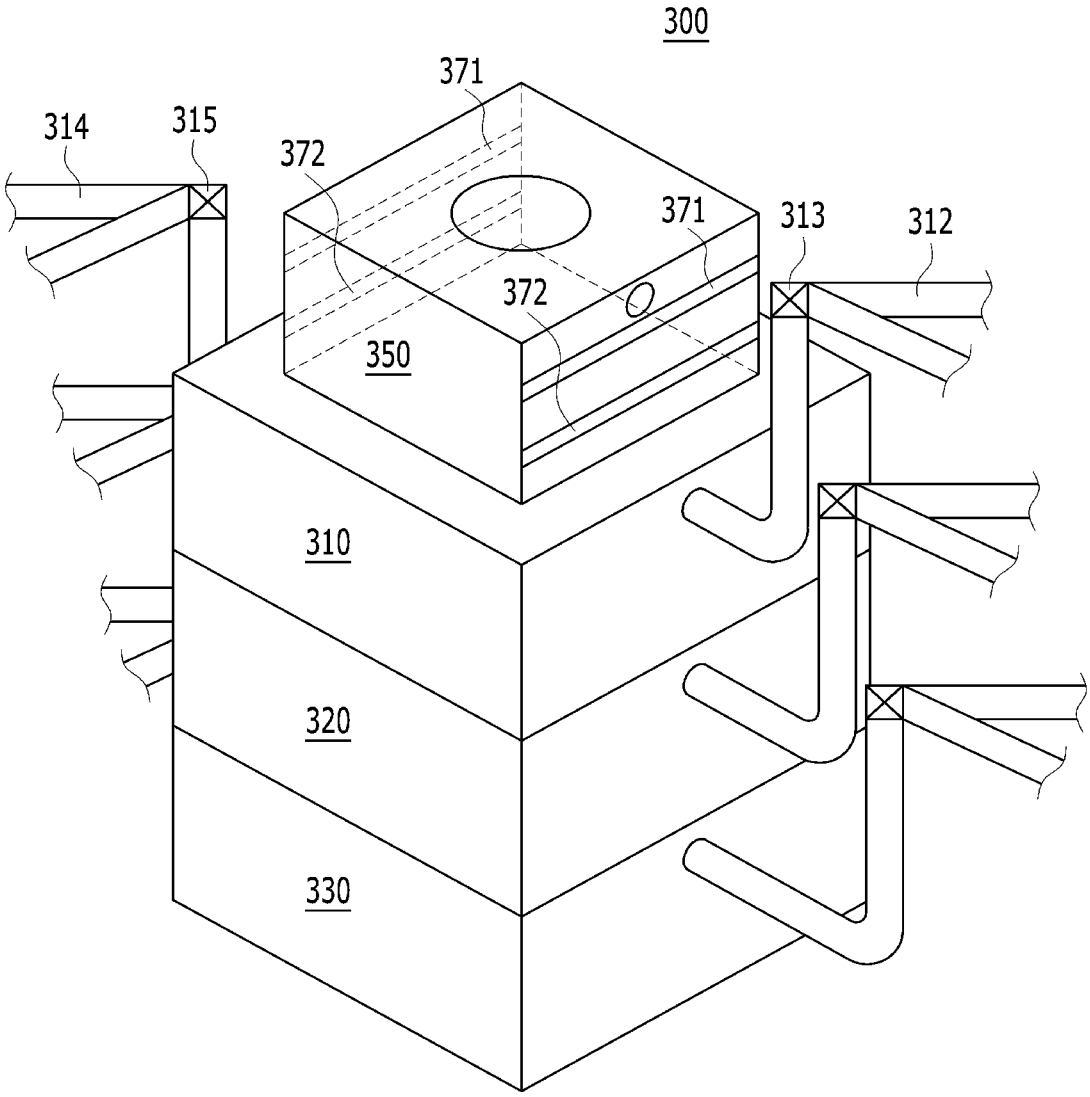
FIG. 3 is a schematically perspective view of a multistory crude oil refining apparatus according to another preferred embodiment of the present invention.
Figure 4:
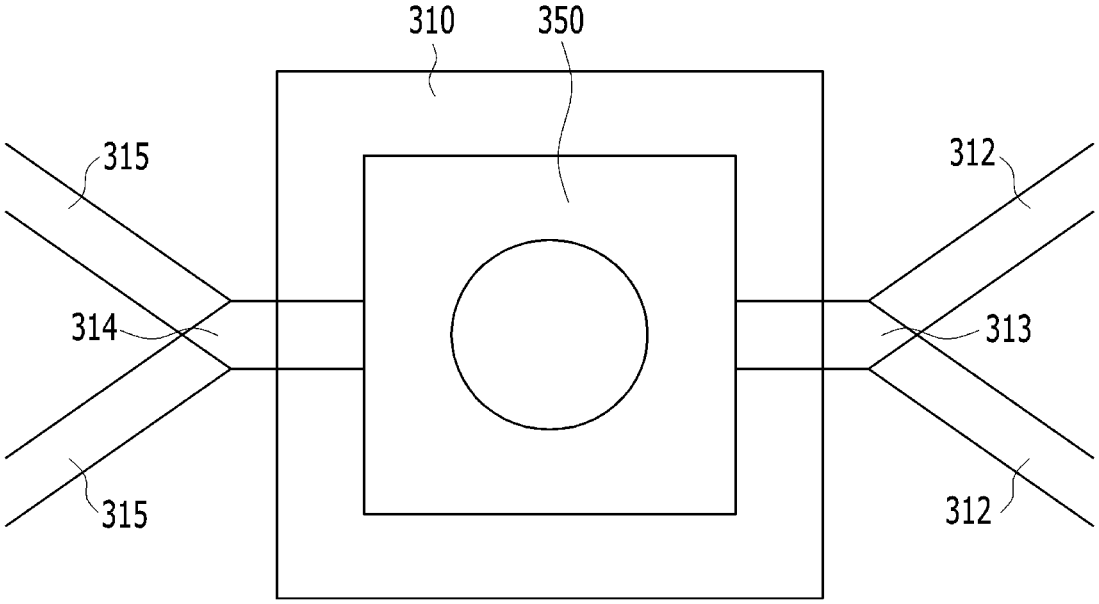
FIG. 4 is a plan view of FIG. 3.

FIG. 3 is a schematically perspective view of a multistory crude oil refining apparatus according to another preferred embodiment of the present invention, and FIG. 4 is a plan view of FIG. 3.

Referring to the drawings, the multistory crude oil refining apparatus 300 according to the second preferred embodiment of the present invention has a vertically arranged multistory structure, and is capable of individually and continuously producing naphtha, kerosene, diesel, and residue from crude oil through pressure control, producing products of various forms using activation of oil through the property that oils have different boiling points, reducing an occupied area of facilities, and enhancing productivity per unit time. The multistory crude oil refining apparatus 300 according to the preferred embodiment of the present invention includes a crude oil receiving part 350 having a vertically arranged multistory structure formed along a lower portion, a first refining tank 310, a second refining tank 320, and a third refining tank 330. Because the number of the refining tanks 310, 320 and 330 may be more than that of the drawings, the scope of the present invention is not limited by the drawings.

The first to third refining tanks 310, 320 and 330 and the crude oil receiving part 350 have cooling devices 371 and heating devices 372. In the drawings, it is illustrated that the cooling devices 371 and the heating devices 372 are disposed just on the crude oil receiving part 350, but the cooling devices 371 and the heating devices 372 may be disposed on all of the first, second and third refining tanks 310, 320 and 330 to control temperature inside the corresponding tanks.

Processed oil discharge pipes 312 are respectively disposed at one side of the first, second and third refining tanks 310, 320 and 330 and the crude oil receiving part 350, and impurity discharge pipes 314 are disposed at the other side of each of the first, second and third refining tanks 310, 320 and 330 and the crude oil receiving part 350.

Moreover, pressure sensitive switches 313 and 315 are attached to the processed oil discharge pipe 312 and the impurity discharge pipe 314. Especially, a pressure controller 313 is attached to a branching point of the processed oil discharge pipe 312 to be opened and closed by temperature and pressure in the corresponding tank, so as to produce products of various forms using activation of oil through the property that oils have different boiling points. In other words, because all kinds of gasoline are not the same, the present invention can provide diversification of products according to grades of gasoline.

In the meantime, in this embodiment, a first dummy pipe **112*a* and a second dummy pipe 114*a* are respectively connected to the first processed oil discharge pipe 112 and the first impurity discharge pipe 114, and a second dummy pipe 122*a* and a fourth dummy pipe 124*a* are respectively connected to a second processed oil discharge pipe 122 and a second impurity discharge pipe 124. Additionally, a fifth dummy pipe 132*a* and a sixth dummy pipe 134*a* are respectively connected to a third processed oil discharge pipe 132 and a third impurity discharge pipe 134, and a seventh dummy pipe 142*a* and an eighth dummy pipe 144*a* are respectively connected to a fourth processed oil discharge pipe 142 and a fourth impurity discharge pipe 144**.

The first, third, fifth and seventh dummy pipes **112*a*, 122*a*, 132*a* and 142*a* may be branching channels for collecting the processed oils smoothly, and the second, fourth, sixth and eighth dummy pipes 114*a*, 124*a*, 134*a* and 144*a*** may be branching channels for discharging impurities smoothly, and all of the dummy pipes may be utilized to control timing.

For instance, valves V1 and V2 may be applied to the first and second dummy pipes 112*a* and 114*a* to control use or non-use of the first and second dummy pipes 112*a* and 114*a* so as to match a flow speed of the processed oil to be collected or impurities. Therefore, the multistory crude oil refining apparatus 300 according to this embodiment can control production speed.

Moreover, a cooling device may be attached to the multistory crude oil refining apparatus (not shown in the drawings). The cooling device may include a valve and a cold air supply pipe. That is, the cooling device can match the entire temperature by inducing air with temperature, which is lower than that of the previous step, when the crude oil refining apparatus proceeds to the next step sequentially. For instance, when temperature moves from 100° C. to 110° C., air of 100° C. is induced so as to match the entire temperature.

As described above, the multistory crude oil refining apparatus according to the present invention has the vertically arranged multistory structure, and is capable of individually and continuously producing naphtha, kerosene, diesel, and residue from crude oil through pressure control, reducing an occupied area of facilities, and enhancing productivity per unit time.

While the present invention has been particularly shown and described with reference to exemplary embodiments thereof, it will be understood by those of ordinary skill in the art that the present invention is not limited by the exemplary embodiments and various changes, modifications, and equivalents may be made therein without departing from the technical idea and scope of the present invention and such changes, modifications, and equivalents belong to the claims of the present invention.

What is claimed is:

1. A multistory crude oil refining apparatus comprising:

a crude oil receiving part, which receives crude oil to be refined and has an inlet;

a first refining tank, which is a lower layer of the crude oil receiving part and forms a place to refine the crude oil provided from the crude oil receiving part into a first processed oil, wherein a first heater is mounted in the first refining tank;

at least one first processed oil discharge pipe connected to one side of the first refining tank, wherein the first processed oil refined in the first refining tank is discharged out through the first processed oil discharge pipe;

a first processed oil discharge pipe pressure sensitive switch disposed on the first processed oil discharge pipe to be openable;

at least one first impurity discharge pipe connected to the other side of the first refining tank, wherein impurities on the first refining tank are discharged out through the first impurity discharge pipe;

a first impurity discharge pipe pressure sensitive switch disposed on the first impurity discharge pipe to be openable;

a second refining tank, which is a lower layer of the first refining tank, and forms a place to refine processed oil provided from the first refining tank into a second processed oil, wherein a second heater is mounted in the second refining tank;

at least one second processed oil discharge pipe connected to one side of the second refining tank, wherein the second processed oil refined in the second refining tank is discharged out through the second processed oil discharge pipe;

a second processed oil discharge pipe pressure sensitive switch disposed on the second processed oil discharge pipe to be openable;

at least one second impurity discharge pipe connected to the other side of the second refining tank, wherein impurities on the second refining tank are discharged out through the second impurity discharge pipe; and a second impurity discharge pipe pressure sensitive switch disposed on the second impurity discharge pipe to be openable.

2. The multistory crude oil refining apparatus according to claim 1, further comprising:

a third refining tank, which is a lower layer of the second refining tank, and forms a place to refine processed oil provided from the second refining tank into a third processed oil, wherein a third heater is mounted in the third refining tank;

at least one third processed oil discharge pipe connected to one side of the third refining tank, wherein the third processed oil refined in the third refining tank is discharged out through the third processed oil discharge pipe;

a third processed oil discharge pipe pressure sensitive switch disposed on the third processed oil discharge pipe to be openable;

at least one third impurity discharge pipe connected to the other side of the third refining tank, wherein impurities on the third refining tank are discharged out through the third impurity discharge pipe; and a third impurity discharge pipe pressure sensitive switch disposed on the third impurity discharge pipe to be openable.

3. The multistory crude oil refining apparatus according to claim 2, further comprising:

a fourth refining tank, which is a lower layer of the third refining tank, and forms a place to refine processed oil provided from the third refining tank into a fourth processed oil, wherein a fourth heater is mounted in the fourth refining tank;

at least one fourth processed oil discharge pipe connected to one side of the fourth refining tank, wherein the fourth processed oil refined in the fourth refining tank is discharged out through the fourth processed oil discharge pipe;

a fourth processed oil discharge pipe pressure sensitive switch disposed on the fourth processed oil discharge pipe to be openable;

at least one fourth impurity discharge pipe connected to the other side of the fourth refining tank, wherein impurities on the fourth refining tank are discharged out through the fourth impurity discharge pipe; and a fourth impurity discharge pipe pressure sensitive switch disposed on the fourth impurity discharge pipe to be openable.

4. The multistory crude oil refining apparatus according to claim 3, wherein the first processed oil, the second processed oil, the third processed oil, and the fourth processed oil are respectively naphtha, kerosene, diesel, and residue, which have different boiling points, wherein the first refining tank, the second refining tank, the third refining tank, and the fourth refining tank form a vertically arranged multistory structure, and wherein a first gate valve is disposed between the first refining tank and the second refining tank, a second gate valve is disposed between the second refining tank and the third refining tank, and a third gate valve is disposed between the third refining tank and the fourth refining tank.

5. The multistory crude oil refining apparatus according to claim 4, further comprising:

a controller for controlling operations of the first to fourth processed oil discharge pipe pressure sensitive switches and the first to fourth impurity discharge pipe pressure sensitive switches and operations of the first to third gate valves by the action of the first to fourth heaters.

6. The multistory crude oil refining apparatus according to claim 3, wherein the first refining tank, the second refining tank, the third refining tank, and the fourth refining tank have different sizes from one another, and have volumes increasing downwards.

* * * * *